US010104990B2

(12) United States Patent
McCullough

(10) Patent No.: US 10,104,990 B2
(45) Date of Patent: Oct. 23, 2018

(54) BED SKIRT

(71) Applicant: Erin Puaala McCullough, Kailua Kona, HI (US)

(72) Inventor: Erin Puaala McCullough, Kailua Kona, HI (US)

( * ) Notice: Subject to any disclaimer, the term of this patent is extended or adjusted under 35 U.S.C. 154(b) by 0 days.

(21) Appl. No.: 15/603,647

(22) Filed: May 24, 2017

(65) Prior Publication Data

US 2017/0340145 A1 Nov. 30, 2017

Related U.S. Application Data

(60) Provisional application No. 62/340,836, filed on May 24, 2016.

(51) Int. Cl.
*A47G 9/02* (2006.01)

(52) U.S. Cl.
CPC ..... *A47G 9/0292* (2013.01); *A47G 9/0246* (2013.01)

(58) Field of Classification Search
CPC ... A47G 9/0284; A47G 9/0292; A47G 9/0246
See application file for complete search history.

(56) References Cited

U.S. PATENT DOCUMENTS 3,144,666 A * 8/1964 Ragsdale Mazera ..... A47G 9/0284 5/493
4,386,439 A * 6/1983 Roccograndi ..... A47G 9/0284 5/493
4,734,947 A * 4/1988 Vitale ..... A47G 9/0253 5/493
5,621,931 A 4/1997 Hamilton
5,733,397 A 3/1998 McDaniel
6,035,469 A 3/2000 Schrougham
6,427,266 B2 8/2002 Talley-Williams
6,557,193 B1 5/2003 Griffith
6,886,197 B1 * 5/2005 Madigan ..... A47G 9/02 5/482
7,089,611 B1 8/2006 Jones et al.
7,093,310 B2 8/2006 Barros
7,140,053 B1 11/2006 Mangano
7,849,532 B1 * 12/2010 Servais ..... A47G 9/0246 5/486
9,211,022 B2 12/2015 Broussard
9,357,863 B1 6/2016 Goenka
2003/0028965 A1 2/2003 Wootten, Jr. et al.
2004/0226089 A1 11/2004 Miranda
2004/0231053 A1 * 11/2004 Masoncup ..... A47G 9/0292 5/493
2005/0086740 A1 4/2005 Babjak
2008/0222806 A1 9/2008 Hart
(Continued)

*Primary Examiner* — Eric J Kurilla
(74) *Attorney, Agent, or Firm* — Jason P. Webb; Pearson Butler

(57) ABSTRACT

A bed skirt, comprising a fitted sheet including a continuous pocket of fabric and a securing mechanism (e.g. elastic member, drawstring) disposed about the mouth of the pocket such that a user can secure the fitted sheet about a box spring mattress. The continuous pocket of fabric includes a top portion circumscribed by side portions that completely covers the top and sides of a box spring mattress while in use. A skirt is fixedly coupled to the pocket of fabric near a junction of the top portion and the side portion of the continuous pocket of fabric, wherein the skirt extends down along the side portion when in use.

10 Claims, 5 Drawing Sheets

(56) References Cited

U.S. PATENT DOCUMENTS

| | | | | |
|---|---|---|---|---|
| 2009/0089929 | A1 | 4/2009 | Hampton | |
| 2009/0113629 | A1 | 5/2009 | Tucker | |
| 2010/0293716 | A1 | 11/2010 | Morgan | |
| 2011/0167561 | A1 | 7/2011 | Gatzke | |
| 2011/0302715 | A1 | 12/2011 | Battaglia et al. | |
| 2012/0204348 | A1 | 8/2012 | Bayer | |
| 2012/0233775 | A1* | 9/2012 | Flinn | A47G 9/0292 5/493 |
| 2016/0324342 | A1 | 11/2016 | Khan | |
| 2017/0000272 | A1* | 1/2017 | Caruso | A47G 9/0292 |
| 2017/0164767 | A1* | 6/2017 | Serafini | A47G 9/04 |

* cited by examiner

BED SKIRT

CROSS-REFERENCE TO RELATED APPLICATIONS

This invention claims priority, under 35 U.S.C. § 120, to the U.S. Provisional Patent Application No. 62/340,836 by McCullough filed on May 24, 2016, which is incorporated by reference herein in its entirety.

BACKGROUND OF THE INVENTION

Field of the Invention

The present invention relates to bedding, specifically to bed skirts.

Description of the Related Art

A bed skirt or valence gives a stylish appearance to a bed without exposing the sides of the box spring and/or space under the bed. Such may also reduce drafts of air through the underside of a bed and/or prevent dust from accumulating thereunder.

Bed skirts are often employed in hotels, especially those of a higher quality, to improve the appearance of the room and give a sense of luxury. They include fabric that drapes down along the sides of the box springs and may drape further, even to the floor.

There are many varieties of bed skirts along with various decorative elements that may be added thereto, including but not limited to embroidery, printed patterns, cuts, hems, quilting, lace, and the like and combinations thereof.

In the related art, it has been known to use bed skirts to improve the experience of those in a bedroom, to reduce the appearance of clutter and to simplify the view and/or make it more elegant. However, bed skirts are sometimes difficult to apply/install, to clean, and/or to replace. Some improvements have been made in the field. Examples of references related to the present invention are described below in their own words, and the supporting teachings of each reference are incorporated by reference herein:

U.S. Pat. No. 6,886,197, issued to Madigan, discloses an assembly of bedclothes for a mattress for making a bed, and more specifically, to: a mattress cover; a bottom sheet; a top sheet; one or more blankets; a bed assembly covering in the front of a bedspread, comforter or duvet cover; and a dust ruffle; and to a method of assembling and fastening said bedclothes assembly. A second embodiment provides for the top and bottom sheets to be integrated.

U.S. Pat. No. 9,211,022, issued to Broussard, discloses a compartmentalized bed skirt assembly for use over a box spring of a bed being formed with a top portion generally configured in a rectangular shape that conventionally covers the box spring portion of a mattress set fitting between the box spring and the mattress. Vertically extended portions are secured to the top portion of the bed skirt and extends downward to the floor on two sides and at the foot end of the bed. The vertically extended portions forms a series of panels or flaps that touch or slightly overlaps an adjacent flap, each flap being totally independent from the adjacent flap to allow lifting of the flap to the point of touching the mattress that rests on top of the box spring. The lifting of a panel or flap does not cause lifting of the adjacent panel or flap.

U.S. Pat. No. 9,357,863, issued to Goenka, discloses a mattress cover and skirt system includes a skirt configured to be secured to the mattress. The skirt includes a flexible skirt panel defining an upper edge, a lower edge, and an elastic element disposed along at least a portion of the lower edge. The mattress cover system includes a mattress cover panel configured to be removably attached to the skirt. The mattress cover panel includes an upper layer, a lower layer, and a cushioning member disposed between the upper and lower layers. A connector system includes at least one first connector member disposed along the upper edge of the skirt and at least one second connector member disposed proximate the outermost edge of the mattress cover panel. The second connector member is configured to engage the first connector member so as to removably attach the mattress cover panel to the skirt.

U.S. Patent Application Publication No. 20100293716, by Morgan, discloses a Lazy Man's Bedspread provides a specially designed line of bedding, including bedspreads and comforters each boasting integrally attached pillow shams, and bed skirts thus enabling the user to make their bed in a fraction of the time associated with traditional methods.

U.S. Patent Application Publication No. 20110302715, by Battaglia et al., discloses a combination flat sheet and fitted bed skirt sheet assembly, and mattress pad assembly. The mattress pad assembly has a top surface, upper and lower edges, retainers for retaining the mattress pad on a mattress, and strips of hook and loop material on the top surface near the upper and lower edge of the mattress pad. The combination flat sheet and fitted bed skirt sheet assembly have a fitted sheet portion having a flat top, upper and lower edges, lateral edges, lateral side skirts extending from the lateral edges, and a foot side skirt extending from the lower edge. Strips of hook and loop material are located on an underside of the flat top near its upper and lower edges. The flat sheet is positioned above the fitted sheet portion and is attached at a lower edge thereof to the lower edge of the fitted sheet portion.

U.S. Patent Application Publication No. 20160324342, by Khan, discloses a fitted blanket [that] fits over the mattress and secures underneath to prevent the blanket from moving off the user while sleeping in bed. The blanket can include an elastic material on at least the underside corner edges thereof to help secure the blanket to the mattress. The fitted blanket includes an opening to allow for easy entry and exit, rather than having to untuck the blanket. The opening may also provide an easy way to make the bed. The opening may simply be designed like a cut in the blanket and may or may not include closing mechanisms. The fitted nature of the blanket prevents blanket slippage or movement. The blanket may further include a cut-out region or an opening along at least a portion of the head end for pillow placement. The blanket can also include glow-in-the-dark elements or illuminated elements to light up the blanket at night.

The inventions heretofore known suffer from a number of disadvantages which include requiring too much time to make the bed therewith; failing to stay in place; requiring multiple people for installation; being difficult to install; being difficult to install by a single person; requiring too much time to turn-over a room (e.g. hotel room); taking too much time of a housekeeper; causing an increase in payroll requirements for hotel cleaning staff; causing an increase in hotel cleaning staff disability claims; not being sturdy, not being stable on the box springs/bed; not self-stabilizing; shifting/falling off during use or when the mattress moves; and/or being likely to rip or tear.

What is needed is a bed skirt that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available bed skirts. Accordingly, the present invention has been developed to provide a bed skirt having a fitted portion.

In one non-limiting embodiment, there is a bed skirt, comprising, consisting of, and/or consisting essentially of: a fitted sheet that may include a continuous pocket of fabric and/or a securing mechanism that may be disposed about the mouth of the pocket such that a user can secure the fitted sheet about a box spring mattress, wherein the continuous pocket of fabric may include a top portion that may be circumscribed by side portions that may completely cover the top and/or sides of a box spring mattress while in use; and/or a skirt that may be fixedly coupled to the pocket of fabric which coupling may be near a junction of the top portion and/or the side portion of the continuous pocket of fabric, and/or wherein the skirt extends down along the side portion when in use.

It may be that the skirt includes three separate skirt panels, one at each of three sides of the fitted sheet. It may be that the skirt couples to the fitted sheet at the top portion above the junction between the top portion and the side portion. It may be that the securing mechanism is a securing mechanism selected from the group of securing mechanisms consisting of elastic members and drawstrings. It may be that the skirt is a multi-layered skirt. It may be that the top portion is of a material with a lower coefficient of friction than that of the skirt and/or that of the side portions. It may be that the skirt mates to the fitted sheet at a seam between the top portion and the side portions. It may be that the skirt is coupled to the side portion below the junction between the top portion and the side portion.

In another non-limiting embodiment, there is a bed skirt comprising, consisting or, and/or consisting essentially of a fitted sheet that may have a whole top portion from which a skirt extends downwardly. It may be that the securing mechanism is a securing mechanism selected from the group of securing mechanisms consisting of elastic members and drawstrings; and/or the skirt includes three separate skirt panels, one at each of three sides of the fitted sheet. It may be that the top portion is of a material with a lower coefficient of friction than that of the skirt and that of the side portions. It may be that the skirt is a multi-layered skirt.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
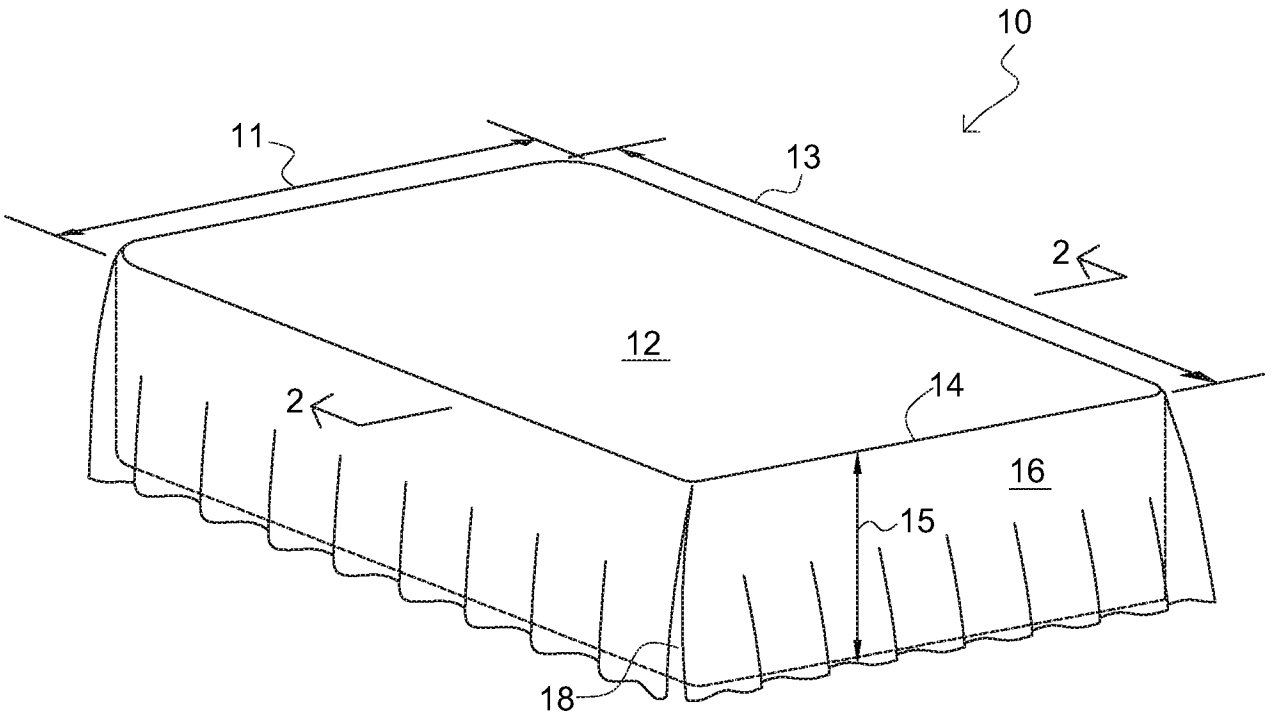
FIG. 1 is a perspective view of a bed skirt installed on a box spring mattress, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

Figure 2:
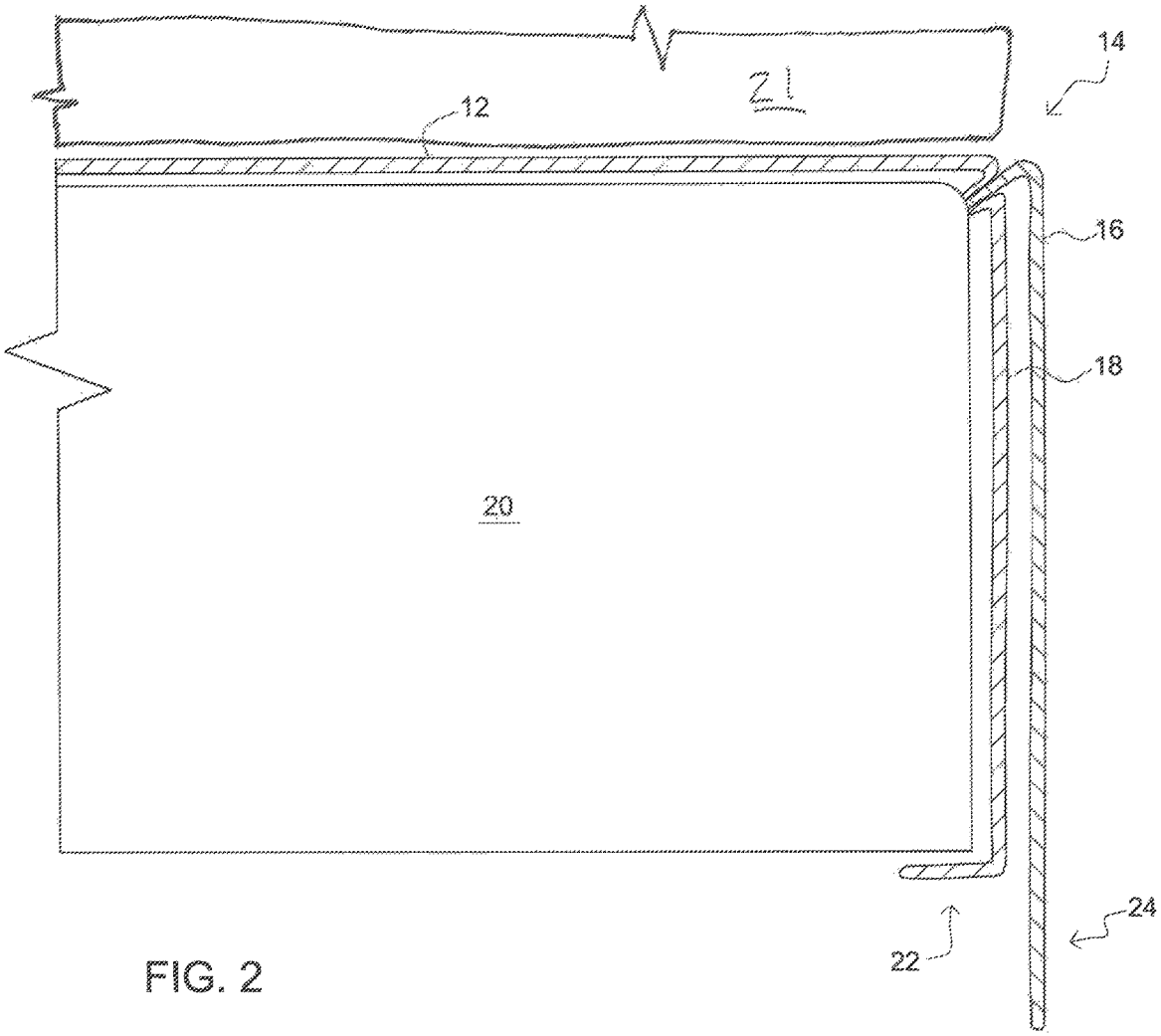
FIG. 2 is a partial cross-sectional view of a bed skirt installed on a box spring mattress, according to one embodiment of the invention.
Figure 3:
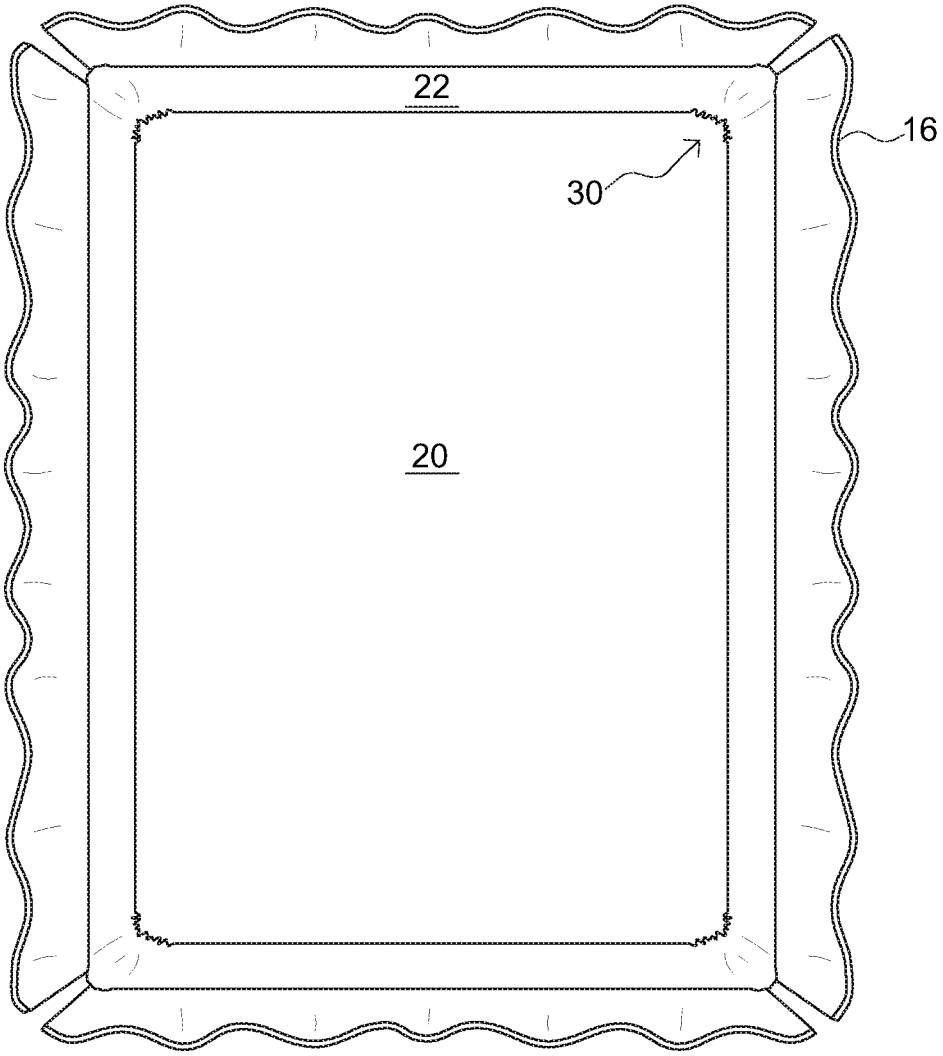
FIG. 3 is a bottom view of a bed skirt installed on a box spring mattress, according to one embodiment of the invention.

FIG. 1 is a perspective view of a bed skirt installed on a box spring mattress, according to one embodiment of the invention; FIG. 2 is a partial cross-sectional view thereof; and FIG. 3 is a bottom view thereof. There is shown a bed skirt 10 including a fitted sheet (12, 18 and 22, together a continuous pocket of fabric) having a top portion 12, side portions 18, and bottom portions 22 (mouth of the pocket of fabric), wherein a securing mechanism 30, disposed at a mouth of the pocket of fabric, allows a user to secure the fitted sheet to a box spring mattress 20. The top portion is circumscribed by the side portions. A skirt 16 is fixedly coupled to and extends downwardly, while in use, from a position (crown 14) near a junction between the op portion 12 and the side portions 18 of the fitted sheet. The bed skirt is fitted about a genericized box spring mattress 20 having a length 13, width 11, and a depth 15 (details regarding the structure of the box spring mattress are not illustrated in order to focus on the structure of the bed skirt itself).

The illustrated fitted sheet is a continuous pocket of fabric (i.e. there are no significant gaps, holes, apertures, etc. through it such that the top mattress 21 makes direct contact with the box spring mattress, even though some portions may be of a different material and/or stitched or otherwise fixedly coupled to each other) into which a box spring mattress may fit. The fitted sheet includes a securing device that allows the mouth of the pocket to open enough to allow the mattress inside, but then allows a user to close the mouth about the bottom thereof to secure the fitted sheet thereto. This is done in a manner very similar to how a fitted sheet is disposed over a top mattress. The fitted sheet completely covers the top of the box spring mattress as well as the sides thereof, but only covers a periphery of the bottom thereof.

The illustrated fitted sheet includes a top portion 12 coupled to a side portion(s) 18 which are coupled to bottom portion(s) 22 having securing devices 30 coupled thereto. The illustrated securing devices are bands of elastic material at interior corners of the bottom portions 22 that bias such corners into a contracted state such that the mouth of the fitted sheet is smaller than a circumference of a bottom of the mattress, but that expand sufficiently to allow the mattress to be inserted into the fitted sheet. Drawstrings or other similar bias members or cinching structures may be utilized to perform the same function. The illustrated top portion 12 is fixedly coupled to the skirt 16 and to the side portion 18 by stitching and/or adhesive or other methods for securing separate panels of material/fabric together, while the side portions 18 and the bottom portions are fixedly coupled together by being of the same woven material. The illustrated top portion 12 may be of a different material (e.g. satin, silk, or other material (e.g. treated fabrics and/or low friction weaves) that has a low coefficient of friction as compared to other more coarse materials) than that of the side/bottom portions 18, 22 and or than the skirt 16. The illustrated skirt 16 includes a bottom end 24 which extends below/beyond the depth of the fitted portion 18.

The illustrated skirt mates to the fitted sheet at a seam between the top portion and the side portions. The illustrated skirt also includes four separate skirt panels, one at each of four sides of the fitted sheet. It may be that, for beds that are up against a wall, as is common in hotels, such skirts may only circumscribe three sides of the fitted sheet, leaving a portion uncovered where the bed butts up against the wall. It may also be that the skirt is a continuous length of material that, as a single panel, covers more than one side of the fitted sheet.

The illustrated securing mechanism is a set of four elastic members sewn into the corners of the mouth of the fitted sheet such that the corners are biased in a contracted mode (see the ruffled material at those corners). Alternatively, the securing mechanism(s) selected from the group of securing mechanisms consisting of elastic member(s) and drawstrings and other bias members and/or cinching mechanisms. As a non-limiting example, instead of four elastic members, there may be a single elastic member that circumscribes the entire mouth of the fitted sheet.

In one non-limiting embodiment, there is a bed skirt comprising a fitted sheet with a whole top portion from which a skirt extends downwardly. It may be that the securing mechanism is a securing mechanism selected from the group of securing mechanisms consisting of elastic members and drawstrings; and/or it may be that the skirt includes three separate skirt panels, one at each of three sides of the fitted sheet. It may be that the top portion is of a material with a lower coefficient of friction than that of the skirt and that of the side portions. It may be that the skirt is a multi-layered skirt.

In another non-limiting embodiment, there is a bed skirt that stays in place. There is a fitted sheet that goes around the box spring and around the exterior of that fitted sheet is a skirt of material/fabric. This facilitates the bed-making process and allows for quick bed-making without having to fix the bed skirt. This is especially helpful for housekeepers, such as in hotels, since bed skirts often move or get fouled by when making a bed. Those problems eat up time for housekeepers.

In still another non-limiting embodiment, there is a bed skirt that has a fitted portion that fits around a box spring under what looks like a normal bed skirt. The fitted portion may go completely around a top portion of the box spring and/or may have elastic around the bottom to adjust its fit to various sizes of box spring mattresses. The draping for the skirt part may be attached to the top of the fitted portion so that it can lay flat to the box spring and look like a normal bed skirt.

In operation, one would take the mattress off the box spring and put the fitted portion of the present invention around the box spring edges and under the box spring, then smooth the "shirt" part down. Then, put the mattress 21 on top of the top portion of the bed skirt (thus also returning the same to the top of the box spring mattress). This allows for the skirt to stay in place, even when the top mattress shifts around.

Such may fit twin, full, queen, king, and/or California king sizes (and others) and may come in a variety of different colors and/or designs. The material that lays under the mattress, which goes across the entire box spring, may be made out of cotton, as may the fitted portion and/or skirt.

Figure 4:
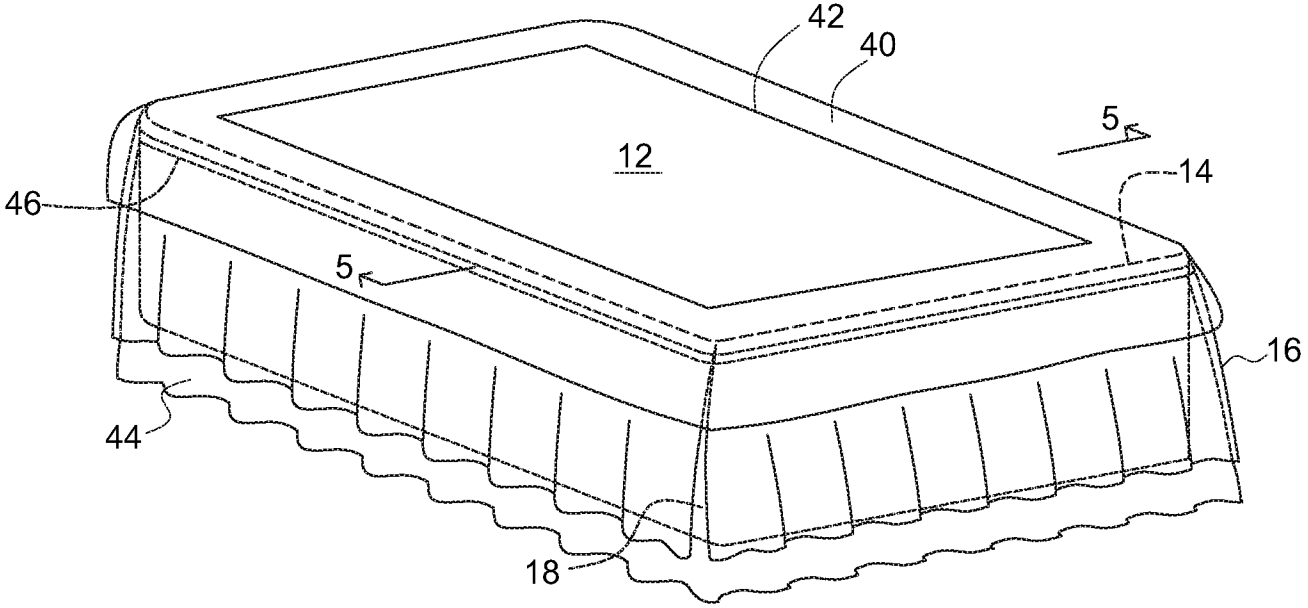
FIG. 4 is a perspective view of a multi-layered bed skirt installed on a box spring mattress, according to one embodiment of the invention.
Figure 5:
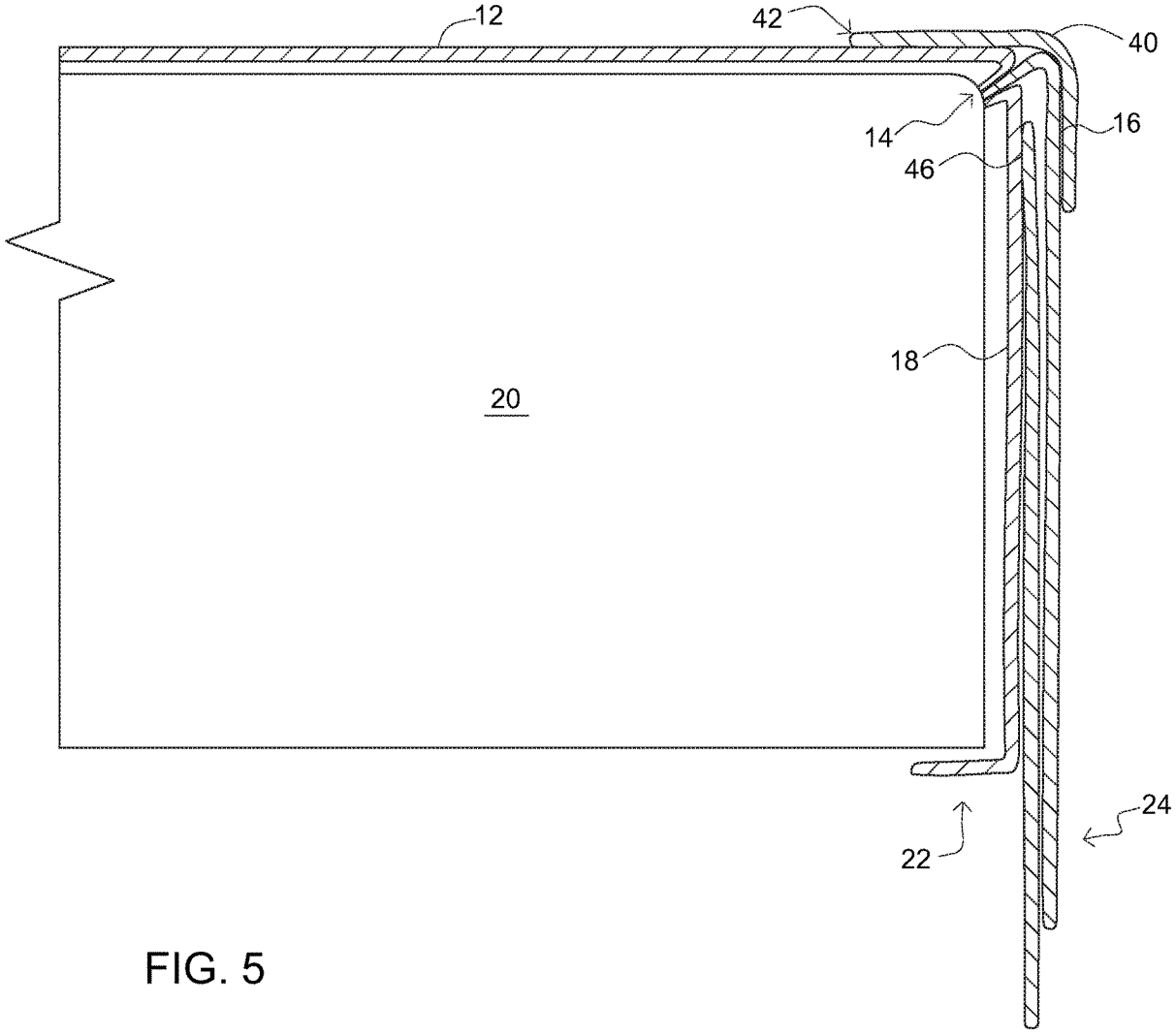
FIG. 5 is a partial cross-sectional view of a multi-layered bed skirt installed on a box spring mattress, according to one embodiment of the invention.

FIG. 4 is a perspective view of a multi-layered bed skirt installed on a box spring mattress, with FIG. 5 being a partial cross-sectional view thereof, according to one embodiment of the invention. There is shown a multilayered bed skirt having three distinct layers of skirt draping therefrom. There is a top skirt 40 disposed over a middle skirt 16 disposed over a bottom skirt 44. While particular skirt positions and lengths are illustrated in combination, it is understood that this embodiment describes a great variety of types of skirts and skirt combinations and couplings that may be used in any combination, not merely that which is illustrated. The bed skirt includes a top portion 12 fixedly coupled to a side portion 18 having a bottom portion 22 that fits about a box spring mattress, thereby forming a continuous pocket into which the mattress may be disposed. The bottom portion includes a securing mechanism or system thereof that permits a user to secure the fitted sheet to the box spring mattress, thereby keeping the bed skirt in place even when the top mattress shifts/moves. The top portion of the fitted sheet is a continuous sheet of material that completely covers the top of the box spring mattress, thereby forming complete and whole layer between the box spring mattress and the top mattress.

Each of the illustrated skirts is coupled near a crown 14 of the fitted sheet, which is the junction between the top portion 12 and the side portion(s) 18. For purposes of this application, the teem "near" means closer to the junction than 50% of the distance to the middle of the top or side portion. As a non-limiting example, if a side portion has a depth of x centimeters, then "fixedly coupled near the crown/junction" would mean that, there is a fixed coupling that is within x/4 centimeters from the crown (even if such a coupling also extends below x/4 centimeters and/or there are additional couplings lower thereto), since x/2 centimeters of depth would be the middle of the side portion.

The illustrated top skirt 40 couples to the fitted sheet at the top portion near and above the junction between the top portion and the side portion. In doing so, it extends a portion of material 42 about a top region circumscribing the top portion 12 of the fitted sheet. It may be fixedly coupled to the top portion 12 by stitches, adhesive, soldering, welding, weaving, heat treatment, or the like or combination thereof. By extending coverage over a portion of the top 12 this allows the bed skirt to look good better than it otherwise would when the top mattress is off-center of the box spring mattress. The illustrated top skirt 40 only extends down a small depth of the side portion 18 and may be a different color/texture/fabric/weave/etc. than that of the other skirt(s) such as to provide a crown appearance.

The illustrated middle skirt 16 couples near and at the junction between the top portion 12 and side portions 18 of the fitted sheet. It may be fixedly coupled to the top portion 12 and/or the side portion 18 by stitches, adhesive, soldering, welding, weaving, heat treatment, or the like or combination thereof. The illustrated middle skirt 16 includes a bottom portion 24 that extends beyond the bottom of the fitted sheet so as to drape below the box spring mattress.

The illustrated bottom skirt 44 is coupled to the side portion near and below the junction between the top portion and the side portion. It may be fixedly coupled 46 to the side portion 18 by stitches, adhesive, soldering, welding, weaving, heat treatment, or the like or combination thereof. The illustrated bottom skirt extends lower than the middle skit 16 thereby allowing viewers to see an additional layer of skirt and further covering the region below the box spring mattress. Such a layer may be scalloped or otherwise shaped for decorative effect, as may any of the other skirt layers.

The illustrated skirts may be of different colors/fabrics/weaves/etc. from each other and/or may include portions that are of different colors/fabrics/weaves/etc.

In one non-limiting embodiment, the skirts extend just along the sides and not including the corners of the fitted sheet.

It may be that a skirt may combine, in any manner and/or combination, any of the characteristics of coupling position/type, length, proportion, portion covered, and the like as those described above and that such may be accomplished using 1, 2, 3 or more skirts and/or skirt panels/portions. As a non-limiting example, there may be a skirt that couples in a manner similar to the illustrated top skirt but extends down below the bottom of the fitted sheet as the illustrated middle and/or bottom skirts do.

In still another non-limiting embodiment, one or more skirts extend a portion of color that matches the skirt color up the top surface so you don't get a white strip if you have a colored skirt and a white top portion of the fitted sheet and the mattress is not on perfectly straight.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the illustrated skirts have no hems or decorative ends, such may include hems and/or decorative portions, such as but not limited to particular decorative pleats, cuts, shapes, ruffles, and the like and combinations thereof.

Additionally, although the figures illustrate particular lengths or proportions of skirts and/or fitted sheets, it is understood that the lengths and proportions of such are plethoric and that the particulars of such may be dictated by the shapes/sizes of beds and/or box spring mattresses to be covered.

It is also envisioned that the skirt may cover a different number of sides of a box spring mattress than that illustrated and/or may be used to cover a mattress or similar structure that is not a box spring mattress.

It is expected that there could be numerous variations of the design of this invention. An example is that the skirt may be one continuous skirt instead of a plurality of skirt sections, one for each side so covered.

Finally, it is envisioned that the components of the device may be constructed of a variety of materials, including but not limited to natural fabrics/fibers (e.g. cotton, wool), synthetic fabrics/fibers (e.g. nylon, rayon), blends, metals/foils, rubbers, polymers, plastics, and the like and combinations thereof.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A bed skirt, comprising:

a. a fitted sheet including a continuous pocket of fabric and a securing mechanism disposed about a mouth of the pocket such that a user can secure the fitted sheet about a box spring mattress having four mattress corners, with the fitted sheet having four corners matching thereto, wherein the continuous pocket of fabric includes a top portion circumscribed by side portions that completely covers the top and sides of a box spring mattress while in use; and b. a skirt fixedly coupled to the pocket of fabric near a junction of the top portion and the side portion of the continuous pocket of fabric and directly to at least one of the top or side portion of the continuous pocket of fabric without any interposing layers, wherein the skirt extends down along the side portion when in use, wherein the skirt fixedly extends to each of the four corners of the fitted sheet, and wherein the skirt is coupled to the side portion only below the junction between the top portion and the side portion.

2. The bed skirt of claim 1, wherein the skirt includes three separate skirt panels, one at each of three sides of the fitted sheet.

3. The bed skirt of claim 1, wherein the skirt couples to the fitted sheet at the junction between the top portion and the side portions, the skirt being coupled between the top portion and the side portions.

4. The bed skirt of claim 1, wherein the securing mechanism is selected from the group consisting of elastic members and drawstrings.

5. The bed skirt of claim 1, wherein the skirt is a multi-layered skirt.

6. The bed skirt of claim 1, wherein the top portion is of a material with a lower coefficient of friction than that of the skirt and that of the side portions.

7. A bed skirt, consisting of:

a. a fitted sheet including a continuous pocket of fabric and a securing mechanism disposed about a mouth of the pocket such that a user can secure the fitted sheet about a box spring mattress, wherein the continuous pocket of fabric includes a top portion circumscribed by four side portions, the top portion coupled to the four side portions at a sewn seam at a top circumferential corner of the sheet that completely covers the top and four sides of a box spring mattress while in use; and b. a single-layered skirt fixedly coupled to the pocket of fabric near a junction of the top portion and the side portions of the continuous pocket of fabric, wherein the skirt extends down along the side portion when in use, and wherein the skirt is fixedly coupled directly to the side portions of the continuous pocket of fabric about an entire length of each of at least three of the side portions of the fitted sheet.

8. The bed skirt of claim 7, wherein the securing mechanism is selected from the group consisting of elastic members and drawstrings.

9. The bed skirt of claim 8, wherein the skirt includes three separate skirt panels, one at each of three sides of the fitted sheet.

10. The bed skirt of claim 8, wherein the top portion is of a material with a lower coefficient of friction than that of the skirt and that of the side portions.

* * * * *